US012721394B2

(12) United States Patent
Abbas

(10) Patent No.: US 12,721,394 B2
(45) Date of Patent: Sep. 1, 2026

(54) SINGLE-CUT SHIRT WITH SINGLE-SEAM CONSTRUCTION AND ASSOCIATED METHODS

(71) Applicant: Nur Abbas, Portland, OR (US)

(72) Inventor: Nur Abbas, Portland, OR (US)

( * ) Notice: Subject to any disclaimer, the term of this patent is extended or adjusted under 35 U.S.C. 154(b) by 0 days.

(21) Appl. No.: 19/394,900

(22) Filed: Nov. 20, 2025

(65) Prior Publication Data

US 2026/0182688 A1 Jul. 2, 2026

Related U.S. Application Data

(60) Provisional application No. 63/741,173, filed on Jan. 2, 2025.

(51) Int. Cl.

| | |
|---|---|
| ***A41B 17/00*** | (2006.01) |
| ***A41B 1/08*** | (2006.01) |
| ***A41H 42/00*** | (2006.01) |

(52) U.S. Cl.

CPC ..... *A41H 42/00* (2013.01); *A41B 1/08* (2013.01); *A41B 2300/35* (2013.01)

(58) Field of Classification Search

CPC .... D04B 1/102; D04B 1/246; A41B 2300/35; A41H 42/00

See application file for complete search history.

(56) References Cited

U.S. PATENT DOCUMENTS

| | | | |
|---|---|---|---|
| 1,278,693 | A | 9/1918 | Leszczynski et al. |
| 1,831,192 | A | 11/1931 | Persky |
| 2,000,073 | A | 5/1935 | Goas et al. |
| 2,126,186 | A | 8/1938 | Friedland |
| 2,285,012 | A | 6/1942 | Burkey |
| 2,417,628 | A | 3/1947 | Brisker |
| 2,598,172 | A | 5/1952 | Davis |
| 2,707,284 | A | 5/1955 | Artzt |

(Continued)

FOREIGN PATENT DOCUMENTS

| | | |
|---|---|---|
| EP | 0211641 A1 | 2/1987 |
| EP | 0387766 A1 | 9/1994 |

OTHER PUBLICATIONS

"Tubular T", by gnuhr, Found Online in [Feb. 2026] https://www.gnuhr.com/products/tubular-t.

(Continued)

*Primary Examiner* — Tajash D Patel

(74) *Attorney, Agent, or Firm* — LegalForce RAPC Worldwide

(57) ABSTRACT

A method of manufacturing a shirt from a continuous tubular fabric is disclosed. The method includes cutting the tubular fabric along an outlined pattern to form a single textile panel that integrates all shirt portions into a continuous piece without separate fabric sections. The textile panel is folded along a shoulder fold to align the front and back portions, creating the upper structure of the shirt. A single continuous seam is formed, extending from one sleeve to the opposite sleeve and passing across the back portion to complete the assembly. The resulting shirt is entirely formed from one tubular fabric and is free of side seams, shoulder seam lines, and back openings. This one-piece, single-seam construction reduces material waste, shortens manufacturing time, and enhances sustainability and scalability in garment production.

17 Claims, 9 Drawing Sheets

(56) References Cited

U.S. PATENT DOCUMENTS

| | | | | |
|---|---|---|---|---|
| 2,858,541 | A * | 11/1958 | Mangan | A41B 9/06 2/113 |
| 3,032,774 | A | 5/1962 | Worth | |
| 3,057,178 | A | 10/1962 | Konklin | |
| 3,474,465 | A | 10/1969 | Artzt | |
| 3,491,375 | A | 1/1970 | Beard et al. | |
| 3,635,051 | A | 1/1972 | Betts et al. | |
| 3,813,901 | A | 6/1974 | Betts et al. | |
| 3,815,385 | A | 6/1974 | Gariboldi | |
| 3,873,999 | A | 4/1975 | Artzt | |
| 3,985,003 | A | 10/1976 | Reed | |
| 4,068,320 | A | 1/1978 | Machacek et al. | |
| 4,111,009 | A | 9/1978 | Robinson et al. | |
| 4,287,612 | A | 9/1981 | Tanaka | |
| 4,682,479 | A | 7/1987 | Pernick | |
| 5,081,854 | A | 1/1992 | Lonati | |
| 5,605,060 | A | 2/1997 | Osborne | |
| 5,613,378 | A | 3/1997 | Popa et al. | |
| 6,125,664 | A | 10/2000 | Browder, Jr. | |
| 6,192,717 | B1 | 2/2001 | Rabinowicz | |
| 6,287,168 | B1 | 9/2001 | Rabinowicz | |
| 6,330,814 | B1 | 12/2001 | Fujiwara | |
| 6,401,498 | B1 | 6/2002 | Fujiwara | |
| 6,550,287 | B1 * | 4/2003 | Sherrill | A41D 1/04 2/113 |
| 6,779,367 | B2 | 8/2004 | Mitchell et al. | |
| 7,017,376 | B2 | 3/2006 | Meckley et al. | |
| 7,395,557 | B1 | 7/2008 | Ledyard | |
| 7,878,030 | B2 | 2/2011 | Burr | |
| 10,368,587 | B2 | 8/2019 | Oliver et al. | |
| 12,156,795 | B2 | 12/2024 | Borrero et al. | |
| 12,268,251 | B1 | 4/2025 | Lugassi et al. | |
| 12,484,646 | B2 * | 12/2025 | Lonati | A41D 1/04 |
| 2002/0133865 | A1 | 9/2002 | Neman | |
| 2005/0079795 | A1 | 4/2005 | Faircloth et al. | |
| 2005/0193777 | A1 | 9/2005 | Sangiacomo | |
| 2016/0258086 | A1 | 9/2016 | Turner | |
| 2018/0249777 | A1 | 9/2018 | Turner | |
| 2021/0348312 | A1 | 11/2021 | Smussi | |
| 2023/0124736 | A1 | 4/2023 | Lonati et al. | |
| 2024/0285005 | A1 * | 8/2024 | Andrews | A41D 13/1209 |

OTHER PUBLICATIONS

"Gnorda Tubular T Alien Throne", by ghuhr, Found Online in [Feb. 2026] https://www.gnuhr.com/products/gnorda-tubular-t-alien-throne.

"360 Tubular Oversized T-Shirt in Black/White", by funfat.textrefer.top, Found Online in [Feb. 2026] https://funfat.textrefer.top/index.php?main_page=product_info&products_id=1773312.

"Next Level Apparel Ideal Tubular T-Shirt", by Next Level Apparel,, Found Online in [Feb. 2026] https://www.statononline.com/product/1810NL/Ideal-Tubular-T-Shirt.html?color=MID.

"Men's S/S Tubular T-Shirt", by cottonheritage, Found Online in [Feb. 2026] https://www.cottonheritage.com/product/M1045/Mens-SS-Tubular-T-Shirt.html.

"What are a Single Stitch T-shirts?", by Ragstock, Found Online in [Feb. 2026] https://ragstock.com/a/blog/what-are-single-stitch-t-shirts?srsltid=AfmBOooqTgHumloYfMqv7F4fM9iwE7oK6bnopMHk7PNPNzdDIKIc6lk1.

* cited by examiner

SINGLE-CUT SHIRT WITH SINGLE-SEAM CONSTRUCTION AND ASSOCIATED METHODS

CLAIM OF PRIORITY

This application is a U.S. Utility Conversion Patent Application of U.S. Provisional Ser. No. 63/741,173 titled 'METHOD FOR MANUFACTURING ONE-PIECE TUBULAR APPAREL WITH SINGLE-SEAM CONSTRUCTION FOR SCALABLE AND SUSTAINABLE GARMENT PRODUCTION' filed on Jan. 2, 2025. The content of the aforementioned application is incorporated by reference in the entirety.

FIELD OF TECHNOLOGY

This disclosure generally relates to garment production and, more particularly, to a single-cut shirt with single-seam construction and associated methods.

BACKGROUND

Apparel, including but not limited to t-shirts, tops, jerseys, tee, and/or shirts, may be made from various textile materials. The production of apparel may represent a textile manufacturing process that may involve assembling multiple fabric panels through intricate cutting and/or sewing techniques. The construction of apparel may require creating separate sections, including but not limited to front and/or back panels, shoulder yokes, and/or sleeves, which may then be joined together using numerous seams and/or joints. These multiple connection points of the apparel may be necessary for creating a structured garment, but may also introduce significant manufacturing complexities, including but not limited to increased production costs and/or potential wearing discomfort.

Apparel manufacturing may rely on multi-piece pattern construction techniques that may involve intricate cutting and/or complex sewing operations designed for the assembly of individual fabric sections. These manufacturing methods of apparel, while established in the textile industry, may present significant systemic limitations that may challenge both economic efficiency and/or sustainable garment production practices. The conventional approach to manufacturing apparel may create irregularly shaped pattern pieces that may inherently lead to substantial fabric waste during the cutting process, while the requirement for multiple seams may increase labor costs, manufacturing time, and/or production complexity.

Moreover, these manufacturing techniques of apparel may severely constrain the industry's ability to scale production effectively, particularly when potentially confronted with increasing consumer demands for customization and/or environmentally conscious clothing production. The impact of these challenges may manifest in excessive material wastage, escalated production expenses, reduced manufacturing flexibility, and/or compromised garment comfort due to the friction that may be created by numerous seam intersections. Furthermore, the lack of adaptability in traditional designs may inhibit the ability to cater to diverse customer preferences, including but not limited to variations in sleeve lengths, necklines, or fabric weights.

Therefore, these existing methods of apparel production may result in excessive material waste, increased production costs, limited scalability, decreased comfort due to seam friction, and/or may fail to address the growing demand for sustainable apparel manufacturing.

SUMMARY

Disclosed is a single-cut shirt with single-seam construction and associated methods.

In one aspect, a method of manufacturing a shirt includes cutting a continuous tubular fabric along an outlined pattern. The method is configured to form a single textile panel that includes all defined shirt portions in a continuous, unbroken piece when the continuous tubular fabric is cut along the outlined pattern. The method is configured to fold the single textile panel along a shoulder fold. The method is configured to align a front portion with a back portion when the single textile panel is folded along the shoulder fold. The method is configured to create an upper structure of the shirt when the front portion is aligned with the back portion. The method is configured to form a single continuous seam that extends from a first sleeve to a second sleeve. The single continuous seam is configured to begin at a sleeve edge, pass across the back portion, and terminate at an opposite sleeve edge. The single continuous seam is configured to join the front portion and the back portion of the single textile panel to form the shirt in a final assembled form.

The method may result in no seam lines at the top of each shoulder area of the shirt when the shirt is in the final assembled form. The method may form the shirt entirely from a single continuous tubular fabric without incorporating any additional fabric components. The method may provide a final assembled form that includes no back opening, such that the back portion remains a continuous, unbroken portion of the continuous tubular fabric. The method may provide a final assembled form that includes no tie closure, such that the back portion remains a continuous, unbroken portion of the continuous tubular fabric.

The outlined pattern may define an upper horizontal segment that forms an upper back portion of the shirt when assembled. The outlined pattern may descend from the upper horizontal segment along a shallow slope at an angle of approximately 25 to 35 degrees to form a sleeve-cap seam line. The shallow slope may transition into a substantially vertical segment that defines an outer sleeve hem, the outer sleeve hem measuring approximately 6 to 8 inches in a standard adult medium configuration. The outlined pattern may further include a curved segment extending inward from the outer sleeve hem to form a front underarm seam, and a horizontal segment connecting a lower portion of a back panel to the front underarm seam.

The outlined pattern may continue along a horizontal baseline across a lower edge of the continuous tubular fabric to define both a front hem and a back hem, the baseline corresponding to a garment width of approximately 18 to 22 inches when laid flat. An opposing side of the outlined pattern may comprise a continuous uncut vertical edge that maintains the seamless nature of the continuous tubular fabric. The outlined pattern may include a concave semicircular neckline cutout positioned approximately 40 percent of the distance from a lower edge of the continuous tubular fabric, the neckline having a radius between 3.5 and 5 inches. A short vertical section extending upward from the neckline may define a center-back portion that remains uncut, preserving a tubular continuity of the fabric.

The continuous outline may form an elongated asymmetrical contour characterized by smooth, flowing curves and connecting horizontal and vertical segments that collectively define all garment portions in a single integrated piece. Cutting of the outlined pattern may be performed manually by a garment worker using fabric shears and/or automatically by a die-cutting and/or laser-cutting machine. The continuous tubular fabric may define an entire body and sleeve structure of the shirt, such that the final assembled form is formed without addition of supplemental fabric panels.

In another aspect, a shirt includes a single textile panel that includes all defined shirt portions in a continuous, unbroken piece without separate fabric sections cut from a continuous tubular fabric. The shirt is formed entirely from a single continuous tubular fabric without incorporation of any additional fabric components. There are no seam lines at the top of each shoulder area of the shirt when the shirt is in a final assembled form.

The shirt in the final assembled form may include no back opening. The back portion may remain a continuous, unbroken portion of the continuous tubular fabric. The shirt in the final assembled form may include no tie closure. The back portion may remain a continuous, unbroken portion of the continuous tubular fabric.

In yet another aspect, a wearable apparel article includes a single continuous textile panel formed from a continuous tubular fabric. The single continuous textile panel is in an uncut condition with uninterrupted side regions that maintain tubular continuity. The single continuous textile panel is cut along an outline pattern that defines all functional portions of the wearable apparel article, including a front portion, a back portion, a pair of sleeves, and a neckline, in a single integrated piece. A single continuous seam extends from a first sleeve to a second sleeve. The single continuous seam joins the front portion and the back portion of the single continuous textile panel to form the wearable apparel article in a final assembled form. The wearable apparel article is free of a back opening, a tie closure, and separate fabric sections.

The methods and systems disclosed herein may be implemented in any means for achieving various aspects, and may be executed in the form of a non-transitory machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

DETAILED DESCRIPTION

Example embodiments, as described below, may be used to provide a single-cut shirt with single-seam construction and associated methods.

Figure 1A:
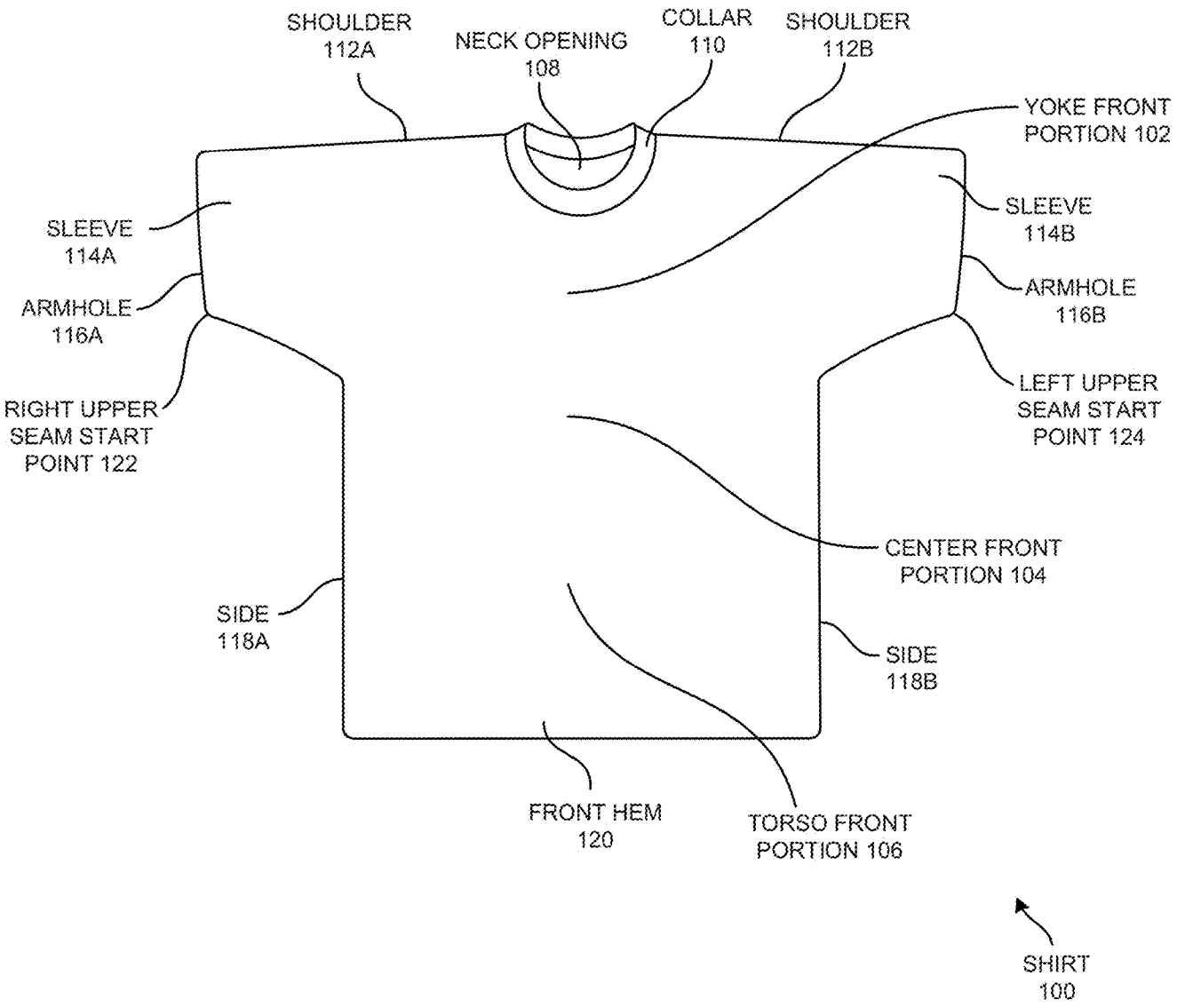
FIG. 1A is a front view of a shirt, according to one or more embodiments.

FIG. 1A is a front view of shirt 100, according to one or more embodiments. FIG. 1A shows the shirt 100 comprising a yoke front portion 102, a center front portion 104, a torso front portion 106, a neck opening 108, a collar 110, a shoulder 112A, a shoulder 112B, an armhole 116A, an armhole 116B, a sleeve 114A, a sleeve 114B, a side 118A, a side 118B, a front hem 120, a right upper seam start point 122, and a left upper seam start point 124.

The shirt 100 may be a garment constructed through a single-piece manufacturing approach. The shirt 100 may comprise a circular knit tube of jersey fabric to create a T-shirt with minimal seams and/or with maximum efficiency. By integrating the entire body and/or sleeve elements into a single pattern piece, the design of the shirt 100 may reduce material waste and/or simplify the production process.

The yoke front portion 102 may be the uppermost section of the front side of the shirt 100, forming the interface between the neck opening 108 and/or the torso front portion 106, according to one embodiment. The yoke front portion 102 may extend laterally to connect with the shoulders 112A and/or 112B to allow smooth transitions to the sleeves 114A and/or 114B, according to one embodiment. The yoke front portion 102 may provide structural support for the neck opening 108 and/or may ensure proper alignment of the neck opening 108 (neckline) with the center portion and/or torso portion of the one-piece tubular 100.

The center front portion 104 may be a central section within the yoke front portion 102, adjacent to the torso front portion 106, according to one embodiment. The center front portion 104 may act as a visual and/or structural guide, ensuring symmetry during assembly, according to one embodiment. The center front portion 104 may also serve as a reference point for aligning the front hem 120 and/or sleeve portions 114A and 114B. The center front portion 104 may enhance the structural integrity of the shirt 100 by providing a continuous connection across the yoke front portion 102 and/or torso front portion 106. The center front portion 104 may support the balanced distribution of fabric tension.

The torso front portion 106 may be a continuation of the yoke front portion 102, which may form the lower front section of the shirt 100. The torso front portion 106 may extend vertically to meet the front hem 120, according to one embodiment. The torso front portion 106 may also align laterally with the sides 118A and 118B to ensure a seamless connection between the front and/or back portions of the shirt 100.

The neck opening 108 may be centrally located within the yoke front portion 102 and/or yoke back portion 136. The neck opening 108 may serve as the access point for the wearer's head and may comprise reinforced edges to prevent deformation. The neck opening 108 may align seamlessly with the collar 110 to provide additional structural stability and/or complete the upper framework of the shirt 100, according to one embodiment. The shirt 100 may include a range of necklines, depending on desired aesthetics.

The collar 110 may surround the neck opening 108, which may provide structural reinforcement and/or a finished edge to the collar 110. The collar 110 may connect to the yoke front portion 102 and/or yoke back portion 136. The collar 110 may also add rigidity to the neck opening 108 to prevent overstretching and/or enhance the overall structural durability of the shirt 100.

The shoulder 112A and/or the shoulder 112B may connect the yoke front portion 102 to the sleeves 114A and/or 114B, according to one embodiment. The shoulders 112A and/or 112B may also distribute tension across the upper section of the shirt, enhancing stability during wear.

The armhole 116A and/or the armhole 116B may define the openings in the shirt 100 for the wearer's arms to pass through between the yoke front portion 102, the yoke back portion 136, and/or the sleeves 114A and/or 114B according to one embodiment. The armholes 116A and/or 116B may provide mobility and/or comfort to the wearer to ensure the fabric does not restrict arm movement.

The sleeve 114A and/or the sleeve 114B may extend outward from the shoulders 112A and/or 112B, forming a tubular structure, according to one embodiment. The sleeves 114A and/or 114B may include front and back portions, aligned with the torso front portion 106 and/or torso back portion 140, according to one embodiment. The sleeves 114A and/or 114B may be designed to accommodate different lengths and/or styles, seamlessly connecting to the one continuous seam 142 for a unified appearance. The shirt 100 may include a range of sleeve lengths, depending on desired aesthetics.

The side 118A and/or the side 118B may form the lateral edges of the shirt 100, which may connect the torso front portion 106 to the torso back portion 140. The side 118A and/or the side 118B may ensure alignment across the front and back structures. The side 118A and/or the side 118B may also serve as reference points for aligning the hem and/or sleeve portions during assembly to ensure consistency in the shirt's 100 overall structure.

The front hem 120 may be the lower edge of the torso front portion 106, which may provide a finished boundary for the shirt's 100 front structure. The front hem 120 may align with the back hem 134 to form a continuous edge around the lower section of the shirt 100, according to one embodiment. The front hem 120 may be reinforced to maintain its structural integrity to prevent fraying and/or ensure a secure fit around the wearer's body. The shirt 100 may include a range of hem styles, depending on desired aesthetics.

The right upper seam start point 122 may be the initial sewing point for the one continuous seam 142 on the right side of the shirt 100. The right upper seam start point 122 may be located at the junction where the yoke front portion 102 and/or the yoke back portion 136 meet the sleeve 114A. The right upper seam start point 122 may serve as a reference for aligning fabric sections during the sewing process to ensure precision and/or symmetry in the shirt 100 assembly.

The left upper seam start point 124 may define the initial sewing point for the one continuous seam 142 on the left side of the shirt 100. The right upper seam start point 122 may be positioned at the junction where the yoke front portion 102 and/or the yoke back portion 136 meet the sleeve 114B, according to one embodiment. The left upper seam start point 124 may ensure that the left side of the shirt 100 mirrors the right side to maintain the structural balance of the shirt 100.

Figure 1B:
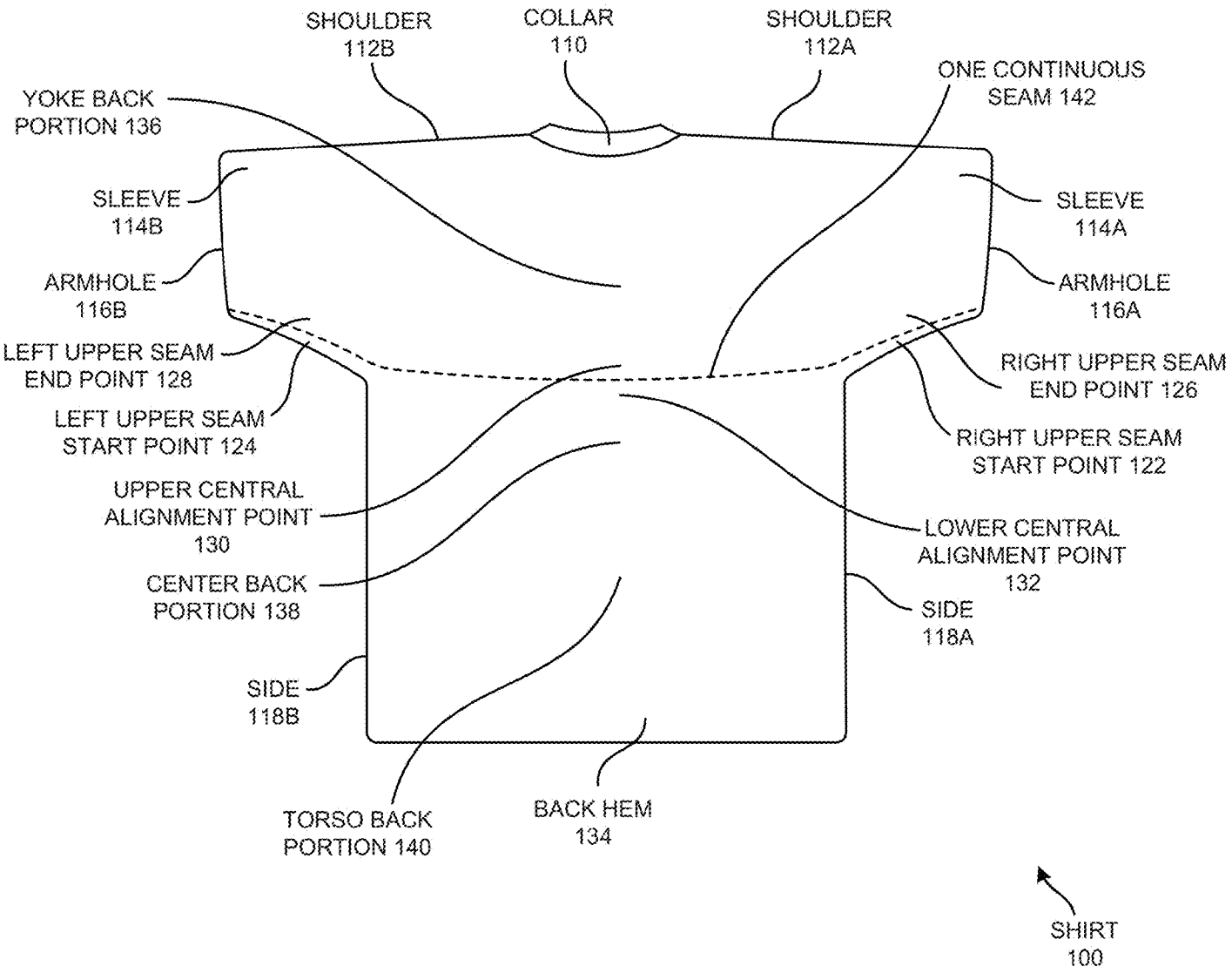
FIG. 1B is a back view of the shirt, according to one or more embodiments.

FIG. 1B is a back view of shirt 100, according to one or more embodiments. FIG. 1B shows the shirt 100 comprising the collar 110, the shoulder 112A, the shoulder 112B, the armhole 116A, the armhole 116B, the sleeve 114A, the sleeve 114B, the side 118A, the side 118B, the right upper seam start point 122, the left upper seam start point 124, a right upper seam end point 126, a left upper seam end point 128, an upper central alignment point 130, a lower central alignment point 132, a back hem 134, a yoke back portion 136, a center back portion 138, a torso back portion 140, and a one continuous seam 142.

The right upper seam end point 126 may be the final alignment point on the right side of the tubular textile material 202, which may indicate where the one continuous seam 142 terminates, according to one embodiment. The right upper seam end point 126 may ensure the proper orientation of the sleeve 114A with respect to the yoke back portion 136 and/or the torso back portion 140. The right upper seam end point 126 may serve as a marker during the alignment and/or sewing process to ensure that the one continuous seam 142 extends continuously and/or evenly along the designated sections.

The left upper seam end point 128 may be the corresponding termination point on the left side of the tubular textile material 202, which may mirror the right upper seam end point 126, according to one embodiment. The left upper seam end point 128 may align the sleeve 114B with the yoke back portion 136 and/or the torso back portion 140 to ensure symmetry in the garment's construction. The left upper seam end point 128 may act as a reference for completing the one continuous seam 142 and/or maintaining alignment across the back section of the shirt 100.

The upper central alignment point 130 may be a reference point located at the upper back section of the tubular textile material 202. The upper central alignment point 130 may ensure the alignment of the yoke back portion 136 with the torso back portion 140, which may act as a central guide during the folding and/or sewing operations. The upper central alignment point 130 may play a role in distributing tension evenly across the one continuous seam 142 to reduce the likelihood of deformation during use, according to one embodiment.

The lower central alignment point 132 may be located at the lower back section of the tubular textile material 202, which may correspond to the upper central alignment point 130, according to one embodiment. The lower central alignment point 132 may guide the alignment of the torso back portion 140 with the yoke back portion 136 to ensure that the back hem 134 is properly oriented during assembly. The lower central alignment point 132 may act as a stabilizing marker, which may prevent misalignment during the folding and/or seaming operations.

The back hem 134 may be the lower edge of the torso back portion 140, which may provide a finished boundary to the back side of the shirt 100. The back hem 134 may contribute to the garment's overall aesthetic by offering a clean and/or professional appearance. The back hem 134 may also be designed to provide structural support to the torso back portion 140 to prevent fraying and/or deformation over time. The back hem 134 may include additional seaming for reinforcement to ensure durability under regular use. Furthermore, the back hem 134 may be elasticized and/or left open, depending on the intended style and/or functionality of the shirt 100. The shirt 100 may include a range of hem styles, depending on desired aesthetics.

The yoke back portion 136 may form the upper back section of the shirt 100, which may connect the collar 110 to the torso back portion 140. The yoke back portion 136 may provide structural support for the neck opening 108 and/or ensure alignment with the sleeves 114A and/or 114B. The yoke back portion 136 may also house alignment points, including but not limited to the upper central alignment point 130 and/or lower central alignment point 132, which are critical during the assembly process. The yoke back portion 136 may enhance the fit and/or comfort of the shirt 100 by distributing tension evenly across the back.

The center back portion 138 may be formed as the central section of the yoke back portion 136, which may connect to the torso back portion 140 along the one continuous seam 142. The center back portion 138 may serve as a primary alignment area for ensuring symmetry between the left and/or right sides of the shirt 100. The center back portion 138 may contribute to the overall structural integrity of the garment by providing a stable connection between the upper and/or lower back sections. The center back portion 138 may also allow for adjustments in the fabric's orientation during the seaming process to ensure a smooth and balanced fit.

The torso back portion 140 may form the main back section of the shirt 100, which may extend from the center back portion 138 to the back hem 134. The torso back portion 140 may provide full coverage for the wearer's back while integrating seamlessly with the yoke back portion 136 and/or sleeves 114A and/or 114B. The torso back portion 140 may be aligned during the folding process to ensure that the one continuous seam 142 runs continuously along its length. The torso back portion 140 may also accommodate additional design features, including but not limited to reinforced seams and/or custom fabric textures to enhance functionality and/or comfort. The torso back portion 140 may contribute to the overall fit and/or aesthetic of the shirt 100.

The one continuous seam 142 may be a continuous seam that joins the sleeves 114A and/or 114B, the yoke front portion 102, the yoke back portion 136, and/or the torso back portion 140 of the shirt 100. The one continuous seam 142 may simplify the construction process by eliminating the need for multiple seams, thereby reducing production complexity and/or material waste, according to one embodiment. The one continuous seam 142 may extend from one sleeve 114A to the other sleeve 114B, which may ensure a cohesive and/or durable structure throughout the garment. Additionally, the one continuous seam 142 may be reinforced at stress points, including but not limited to the right upper seam start point 122, the upper central alignment point 130, and/or the left upper seam start point 124, to improve durability. The one continuous seam 142 may also provide a seamless aesthetic, enhancing both the appearance and/or comfort of the shirt 100.

According to one embodiment, FIG. 1A and FIG. 1B disclose a shirt 100 that may include a yoke front portion 102 that may form the upper front section of the shirt 100 and a yoke back portion 136 that may form the upper back section. A center front portion 104 may form the central section of the front side of the shirt 100, while a center back portion 138 may form the central section of the back side. The shirt 100 may include a neck opening 108 positioned centrally within the yoke front portion 102 and/or yoke back portion 136 to provide access for a wearer, according to one embodiment. A pair of armholes 116A and/or 116B may be located on either side of the yoke front portion 102 and/or yoke back portion 136 to provide access to the sleeves 114A and/or 114B. The pair of sleeves 114A and/or 114B may extend outward from the armholes 116A and 116B, with each sleeve comprising a sleeve front portion that may form the front section of the sleeve and/or a sleeve back portion that may form the back section. A torso front portion 106 may form the front section of the shirt 100, and a torso back portion 140 may form the back section. Additionally, a front hem 120 may be positioned at the lower edge of the torso front portion 106, and a back hem 134 may be positioned at the lower edge of the torso back portion 140. the shirt 100 may be joined by a one continuous seam 142 that may extend continuously from one sleeve 114A to the other sleeve 114B, passing through the yoke front portion 102, yoke back portion 136, and/or torso back portion 140, thereby joining the sleeves 114A and 114B, yoke portions 102 and 136, and/or torso portions 106 and 140 to form the shirt 100.

Figure 2:
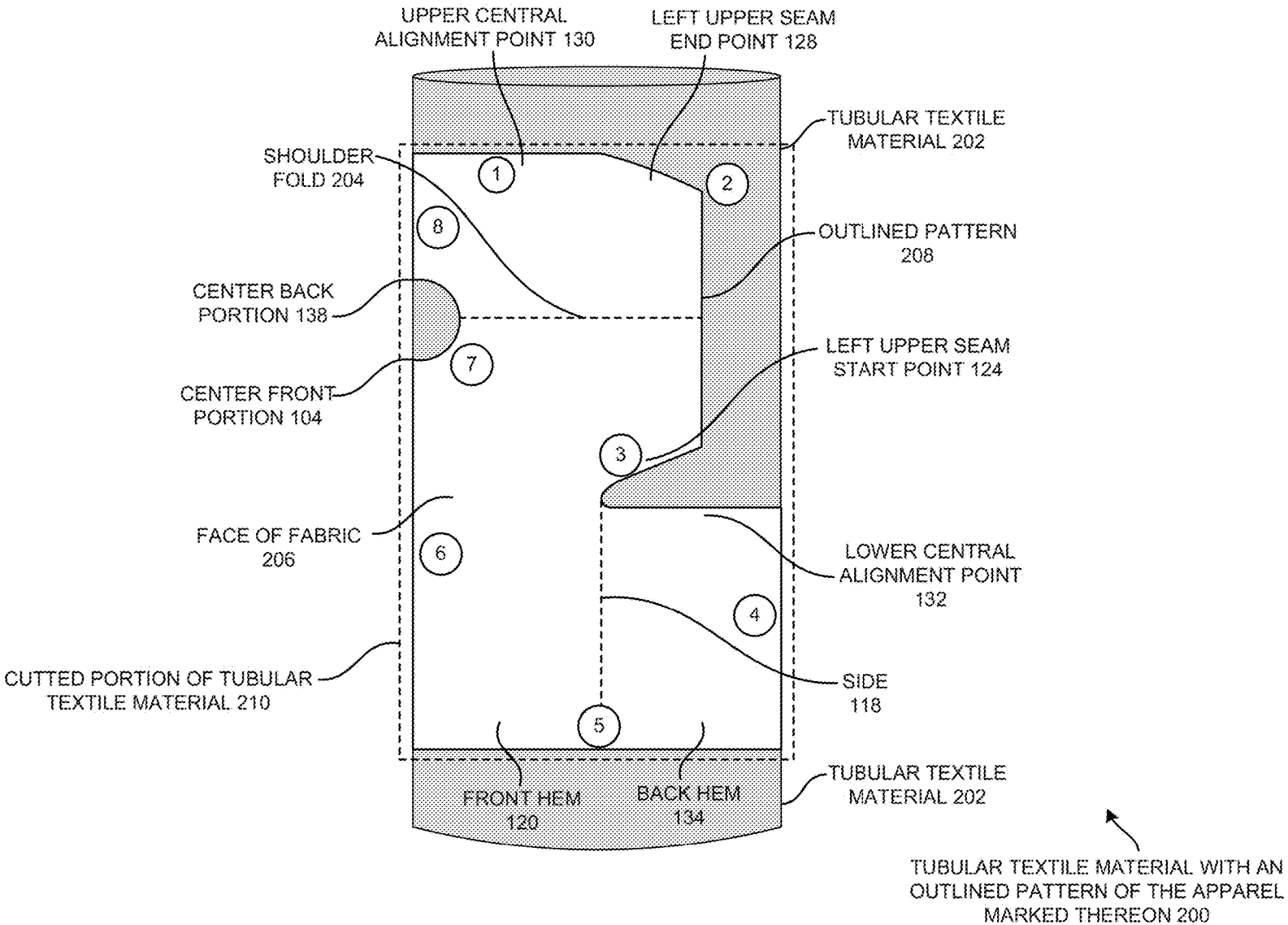
FIG. 2 is a representation of a tubular textile material with an outlined pattern marked thereon, according to one or more embodiments.

FIG. 2 is a representation of a tubular textile material 202 with an outlined pattern 208 marked thereon, according to one or more embodiments. FIG. 2 shows the tubular textile material 202 with an outlined pattern 208 marked thereon, comprising a shoulder fold 204, a face of fabric 206, the yoke front portion 102, the center front portion 104, the front hem 120, the torso front portion 106, the right upper seam start point 122, the left upper seam start point 124, the right upper seam end point 126, the left upper seam end point 128, the upper central alignment point 130, and the lower central alignment point 132, the back hem 134, the yoke back portion 136, the center back portion 138, and the torso back portion 140, according to one or more embodiments.

The tubular textile material 202 may be a continuous cylindrical knit fabric. The tubular textile material 202 may be selected for its stretchability, breathability, and/or durability, which may ensure it can accommodate a range of body sizes and/or shapes. The tubular structure of the tubular textile material 202 may eliminate the need for side seams, simplifying the manufacturing process and/or reducing material waste, according to one embodiment. The tubular textile material 202 may include various types of materials based on the intended application. According to one embodiment, a circular knit jersey, a ribbed knit fabric, a fleece knit material, a compression knit fabric, and/or a mesh knit material may be used.

The shoulder fold 204 may be a folding line on the tubular textile material 202 that defines the transition between the yoke front portion 102 and the yoke back portion 136, and/or the torso front portion 106 and the torso back portion 140 of the shirt 100. The shoulder fold 204 may align the center front portion 104 with the torso front portion 106 and/or the center back portion 138 with the torso back portion 140 during the assembly process. The shoulder fold 204 may also ensure that the sleeves 114A and/or 114B are properly oriented with respect to the yoke and/or torso sections. The shoulder fold 204 may simplify the formation of the neck opening 108 and/or armholes 116A and 116B, which may reduce the need for additional alignment operations. Additionally, the shoulder fold 204 may act as a reference for creating reinforced seaming at the yoke-to-torso junction for enhanced durability.

The face of fabric 206 may be the outer surface of the tubular textile material 202, which may be designed to be exposed when the shirt 100 is worn. The face of fabric 206 may provide a base for decorative elements, including but not limited to prints, patterns, and/or logos, to enhance the visual appeal of the shirt 100. The orientation of the face of fabric 206 during the assembly process may ensure that the shirt 100 has visible elements, including but not limited to the yoke front portion 102 and/or the sleeves 114A and 114B.

The outlined pattern 208 may be a series of predetermined markings on the tubular textile material 202 which may define the shapes and/or boundaries of the shirt 100 sections, including but not limited to the yoke front portion 102, the yoke back portion 136, the torso front portion 106, the torso back portion 140, the sleeves 114A and 114B, the front hem 120, and/or the back hem 134. The outlined pattern 208 may guide the cutting process to ensure precision and/or consistency across multiple apparel units. The outlined pattern 208 may include alignment markers, including but not limited to the shoulder fold 204, the left upper seam start point 124, the left upper seam end point 128, the upper central alignment point 130, the lower central alignment point 132, and/or the center front portion 104. The outlined pattern 208 may also include annotations for alignment points, including but not limited to the right upper seam start point 122, the left upper seam start point 124, the right upper seam end point 126, and/or the left upper seam end point 128, to streamline the assembly process. Additionally, the outlined pattern 208 may be adaptable to different apparel designs, which may enable customization while maintaining the efficiency of the manufacturing workflow.

The trimmed section of the tubular textile material 210 may be derived from the tubular textile material 202, which may be marked with an outlined pattern 208. The cutting process may precisely follow these markings to create a single, unified fabric piece that is ready for folding and/or alignment.

The trimmed section of the tubular textile material 210 may retain the integrity of the tubular structure to ensure a seamless and/or efficient assembly process. The trimmed section of the tubular textile material 210 may include alignment points such as the right upper seam start point 122, left upper seam start point 124, right upper seam end point 126, left upper seam end point 128, upper central alignment point 130, and/or lower central alignment point 132. The trimmed section 210 may also feature the front hem 120 and/or back hem 134.

According to one or more embodiments, FIG. 2 discloses the tubular textile material 202 with an outlined pattern 208 marked thereon, illustrating the preparation stage for manufacturing the shirt 100, according to one embodiment. The tubular textile material 202 may be a continuous knit fabric, including the face of fabric 206 and/or the back of fabric 302.

The outlined pattern 208 may define a unique shape for the fabric that is integral to this method of garment construction. The outlined pattern 208 may form the trimmed section of the tubular textile material 210. The trimmed section of the tubular textile material 210 may comprise the yoke front portion 102, the yoke back portion 136, the center front portion 104, the center back portion 138, the torso front portion 106, the torso back portion 140, the front hem 120, and/or the back hem 134. Alignment markers, including but not limited to the right upper seam start point 122, the right upper seam end point 126, the left upper seam start point 124, the left upper seam end point 128, the upper central alignment point 130, and/or the lower central alignment point 132 may also include in the outlined pattern 208 to ensure precise alignment and assembly during folding and/or seaming.

The cutting process may separate this uniquely shaped fabric piece from the tubular textile material 202, which may transform it into a single piece that eliminates the need for additional panels and/or components. Advanced cutting techniques, including but not limited to laser cutting, rotary blade systems, and/or automated cutting machines, may be used to achieve high precision and/or consistency.

The illustrated pattern in FIG. 2 represents a single continuous outline (e.g., outline pattern 208) cut formed (cutted portion of tubular textile material 210) within a tubular textile material 202, wherein the outer edges of the tubular textile material 202 remain unbroken to preserve the integrity of the continuous structure, according to one embodiment. The outline (e.g., outline pattern 208) defines the principal shape of the garment—including its sleeves, neckline (e.g., neck opening 108), and lower hems (e.g., front hem 120 and back hem 134)—all derived from a single integrated piece of fabric that requires only one seam (e.g., single continuous seam 142) to complete assembly, according to one embodiment.

Beginning at the upper-left portion of the pattern of FIG. 2, the horizontal upper line defines what will become the upper back region (e.g., yoke back portion 136) of the finished garment, extending laterally across the tubular fabric as shown in circle '1' in FIG. 2, according to one embodiment. Progressing clockwise from this point, the line descends along a shallow slope, at an approximate 25-35° downward inclination, forming the seam line for the sleeve cap (e.g., upper seam between points 124 and 128) as shown in circle '2' in FIG. 2, according to one embodiment. This shallow slope transitions smoothly into a vertical segment, which defines the outer hem of the sleeve (e.g., sleeve edge 114A or 114B), as shown in circle '3' in FIG. 2, according to one embodiment. In a standard adult medium, this vertical sleeve hem may measure approximately 6-8 inches in length, though it may vary proportionally with size, according to one embodiment.

Continuing downward and around, the outline in FIG. 2 transitions from the sleeve hem into another gentle downward slope, curving inward toward the garment's torso region to form the front underarm seam (e.g., armhole 116A or 116B) as shown in circle '4' in FIG. 2, according to one embodiment. This front underarm curve flows seamlessly into the next horizontal section, which defines the lower portion of the back panel (e.g., torso back portion 140), connecting visually and structurally with the earlier upper horizontal line, according to one embodiment. This horizontal lower-back segment typically spans approximately 9-12 inches, depending on garment width and sleeve drop, according to one embodiment.

As the pattern in FIG. 2 continues, the outline follows a horizontal baseline (e.g., lower boundary of tubular textile material 202) across the lower edge of the tubular material, which defines both the front hem 120 and back hem 134 as shown in circle '5', according to one embodiment. This horizontal plane establishes the lower boundary of the t-shirt and allows for precise hemming or finishing, according to one embodiment. For standard proportions, this hemline may extend across a total garment width of 18-22 inches, representing the full tubular circumference divided into front and back halves, according to one embodiment.

Progressing upward along the opposite (right) side of the pattern in FIG. 2, the outline forms a continuous vertical edge (e.g., side 118A of tubular textile material 202) that remains uncut, maintaining the seamless nature of the tubular fabric along that side as shown in circle '6', according to one embodiment. Approximately 40% of the distance from the bottom, the outline introduces a smooth, concave semicircular cutout representing the neckline region (e.g., neck opening 108), as shown in circle '7', according to one embodiment. This neckline (e.g., neck opening 108) curve-typically having a radius between 3.5 and 5 inches-defines the opening for the wearer's neck and transitions gently back into the upper structure of the fabric, according to one embodiment.

From the apex of this neckline (e.g., neck opening 108), the outline 208 in FIG. 2 rises once more along a short vertical section, forming the center back line (e.g., center back portion 138) of the garment as shown in circle '8', according to one embodiment. This portion remains uncut, preserving the tubular continuity and providing the structural axis along which the garment folds symmetrically, according to one embodiment.

When the embodiment of FIG. 2 is viewed as a whole, the continuous outline 208 forms an elongated, asymmetrical contour that loosely resembles the number "2," characterized by smooth, flowing curves and connecting horizontal and vertical segments, according to one embodiment. The outline can be hand-cut using fabric shears (e.g., manual cutting Step 3 in FIG. 5) or machine-cut using a die or laser cutter (e.g., laser or die cutting), following the same geometry, according to one embodiment. The resulting white region within the tubular fabric constitutes the entire body and sleeve structure of the garment, while the surrounding shaded areas (e.g., uncut portions of tubular fabric 202) of FIG. 2 indicate regions of uncut tubular material that serve as continuity zones or finishing allowances, according to one embodiment. Once cut and folded along the shoulder fold (e.g., 204), this pattern allows for a single continuous seam 142 to be seamed, joining the front portion (e.g., center front portion 104 and torso front portion 106) and back panels (e.g., center back portion 138 and torso back portion 140) and forming a one-piece t-shirt or jersey (e.g., shirt 100) with minimal waste and maximum efficiency, according to one embodiment. For reference, in the embodiment of FIG. 2, a typical adult medium configuration of this outline may have approximate proportions as follows: (1) Total vertical height of pattern: 26-30 inches (2) Width of tubular fabric (flat): 18-22 inches (3) Neckline (e.g., neck opening 108) curve radius: 3.5-5 inches (4) Sleeve vertical hem segment: 6-8 inches (5) Front-to-back torso span (from underarm to hem): 12-15 inches.

These values are illustrative and may be adjusted according to garment size, fabric elasticity, and/or desired fit, according to one embodiment.

Figure 3A:
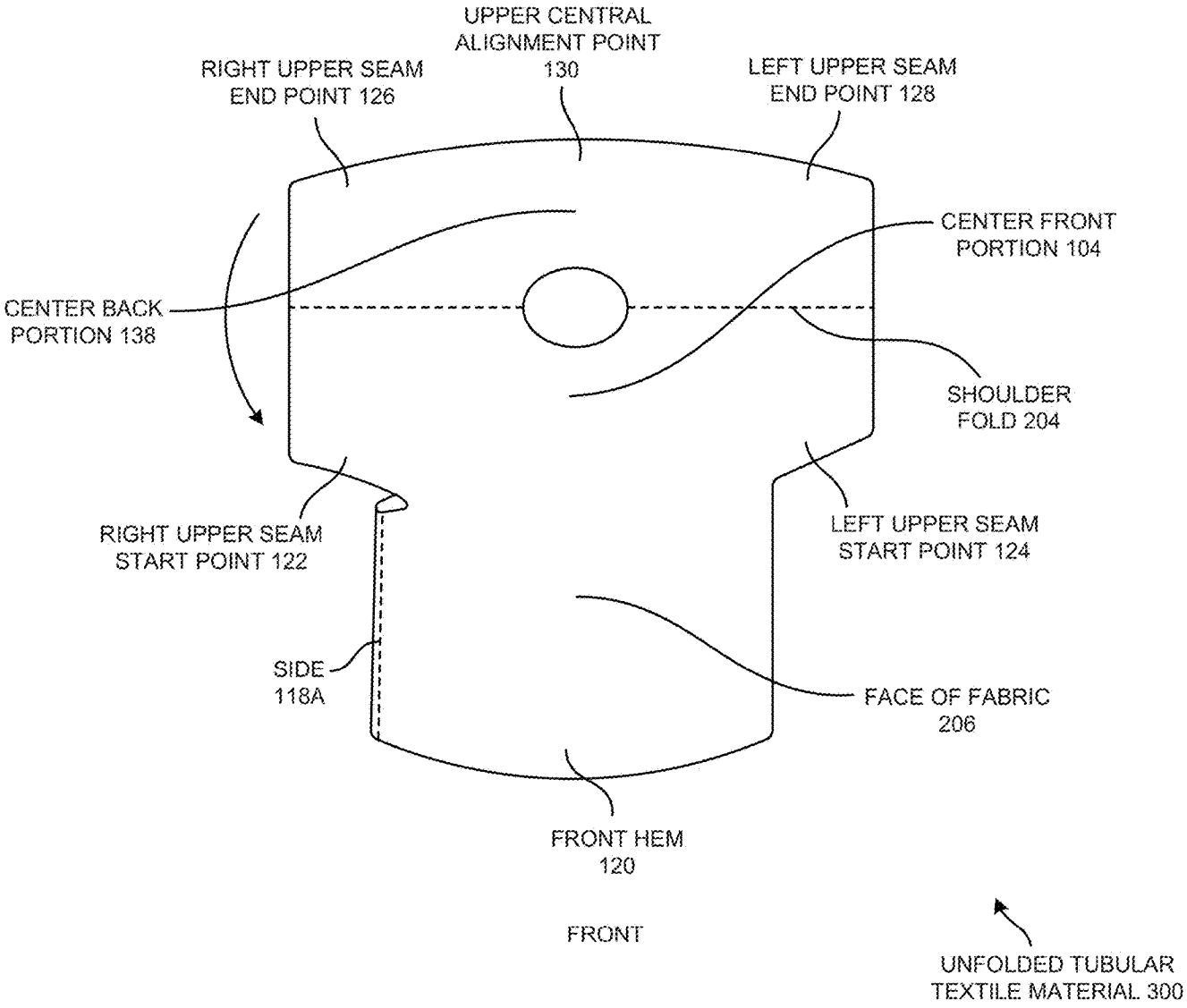
FIG. 3A is a front view of an unfolded tubular textile material, according to one or more embodiments.

FIG. 3A is a front view of an unfolded tubular textile material 300, according to one or more embodiments. FIG. 3A shows the unfolded tubular textile material 300, comprising the yoke front portion 102, the center front portion 104, the torso front portion 106, the front hem 120, the face of fabric 206, the shoulder fold 204, the right upper seam start point 122, the left upper seam start point 124, the right upper seam end point 126, the left upper seam end point 128, the upper central alignment point 130, the lower central alignment point 132, and the back of fabric 302, according to one or more embodiments.

The back of fabric 302 may be the inner surface of the tubular textile material 202, which may be designed to face the wearer's body when the shirt 100 is worn. The back of fabric 302 may stabilize the overall apparel 100 structure and may ensure that the fabric maintains its intended fit and/or shape over time. The orientation of the back of fabric 302 during assembly may ensure that all functional layers of the shirt 100 are properly positioned, according to one embodiment.

Figure 3B:
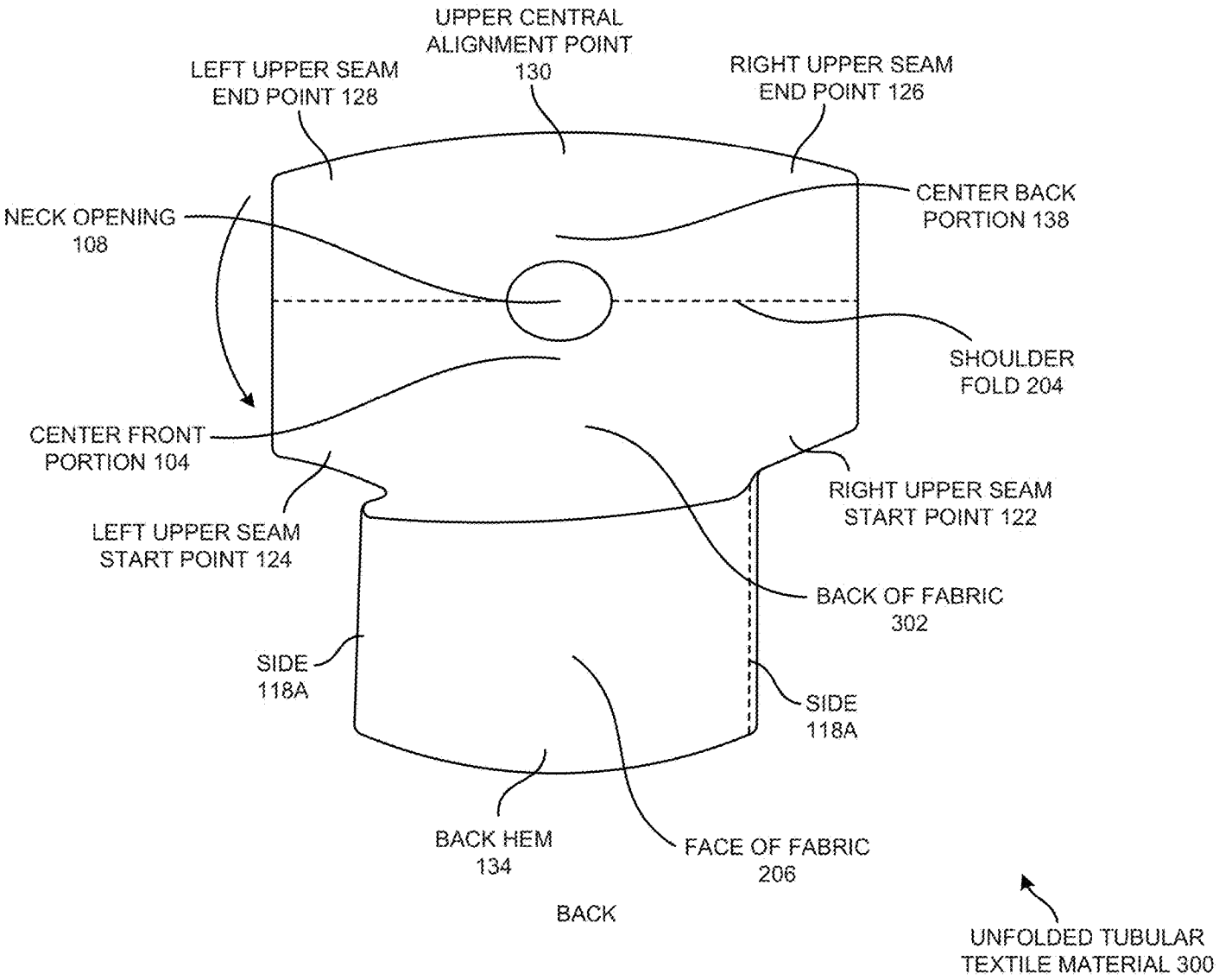
FIG. 3B is a back view of the unfolded tubular textile material, according to one or more embodiments.

FIG. 3B is a back view of the unfolded tubular textile material 300, according to one or more embodiments. FIG. 3B shows the unfolded tubular textile material 300, comprising the yoke back portion 136, the center back portion 138, the torso back portion 140, the back hem 134, the back of fabric 302, the shoulder fold 204, the right upper seam start point 122, the left upper seam start point 124, the right upper seam end point 126, the left upper seam end point 128, the upper central alignment point 130, and the lower central alignment point 132, according to one or more embodiments.

According to one embodiment, FIG. 3A and FIG. 3B disclose the unfolded tubular textile material 300, representing the structure of the shirt 100. The tubular textile material 300 may include the center front portion 104, which may define the central section of the front side of the shirt 100, and/or the center back portion 138, which may define the central section of the back side. The shoulder fold 204 may align the yoke back portion 136 with the torso back portion 140, ensuring symmetry and/or proper fit, according to one embodiment. The unfolded tubular textile material 300 may also provide a face of fabric 206 and/or a back of fabric 302, which may determine the external and internal surfaces of the shirt 100.

The unfolded tubular textile material 300 may further include alignment points including but not limited to the right upper seam start point 122, the left upper seam start point 124, the right upper seam end point 126, the left upper seam end point 128, the upper central alignment point 130, and/or the lower central alignment point 132, which may guide the folding and/or seaming processes. The center front portion 104 may align with the torso front portion 106, while the center back portion 138 may align with the torso back portion 140 to ensure precise seam placement. The tubular structure and/or alignment markers of the unfolded tubular textile material 300 may allow for efficient assembly and/or accurate alignment of all components, including the sleeves 114A and 114B, which extend outward from the armholes 116A and 116B.

Additionally, FIG. 3A may illustrate the front view of the unfolded tubular textile material 300, highlighting the alignment of the face of fabric 206 and its connection to the center front portion 104 and torso front portion 106, according to one embodiment. FIG. 3B may illustrate the back view of the unfolded tubular textile material 300, emphasizing the alignment of the back of fabric 302 with the center back portion 138 and/or the torso back portion 140, according to one embodiment. Together, the figures may provide a comprehensive view of the tubular textile material 300 before it is folded and/or sewn into the final shirt 100.

Figure 4A:
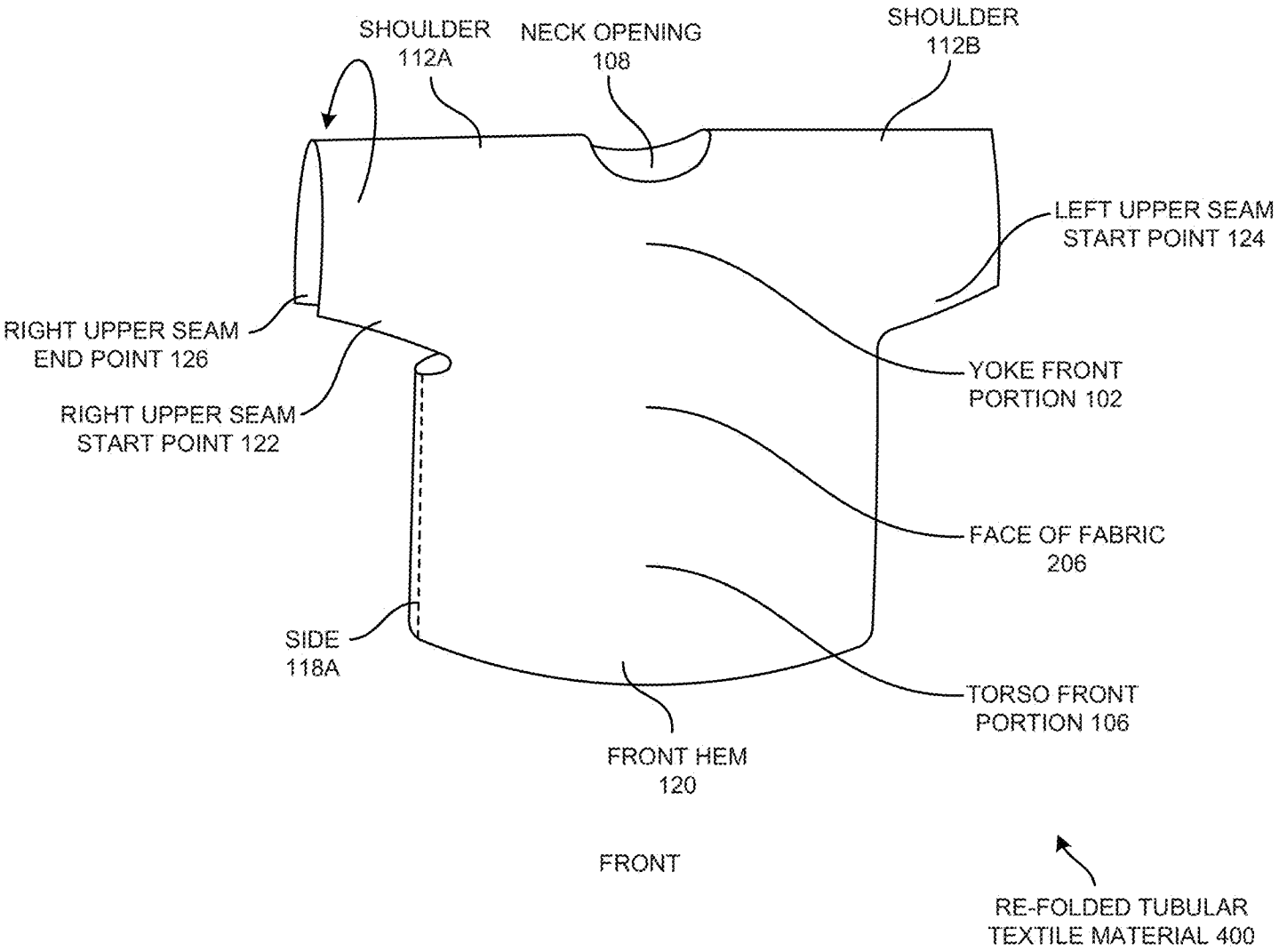
FIG. 4A is a front view of a re-folded tubular textile material, according to one or more embodiments.

FIG. 4A is a front view of a re-folded tubular textile material 400, according to one or more embodiments. FIG. 4A shows the re-folded tubular textile material 400, comprising the yoke front portion 102, the torso front portion 106, the front hem 120, the face of fabric 206, the neck opening 108, the shoulder 112A, the shoulder 112B, the right upper seam start point 122, the left upper seam start point 124, the right upper seam end point 126, the left upper seam end point 128, the upper central alignment point 130, and the lower central alignment point 132, according to one or more embodiments.

According to one embodiment, FIG. 4A discloses the re-folded tubular textile material 400 that may represent the partially assembled state of the shirt 100. The material 400 may include the yoke front portion 102, which may form the upper front section of the shirt 100, and/or may connect to the torso front portion 106, which may form the lower front section. The material 400 may also include a neck opening 108 positioned centrally within the yoke front portion 102 to provide access for a wearer. The shoulder 112A and/or the shoulder 112B may extend laterally from the yoke front portion 102 to align with the armholes for sleeve placement. The front hem 120 may be positioned at the lower edge of the torso front portion 106 to provide a finished boundary for the front side of the shirt 100. The face of fabric 206 may represent the exposed side of the material during assembly. Additionally, alignment points, including but not limited to the right upper seam start point 122, the left upper seam start point 124, and/or the right upper seam end point 126, may facilitate accurate folding and seam placement during the sewing process.

Figure 4B:
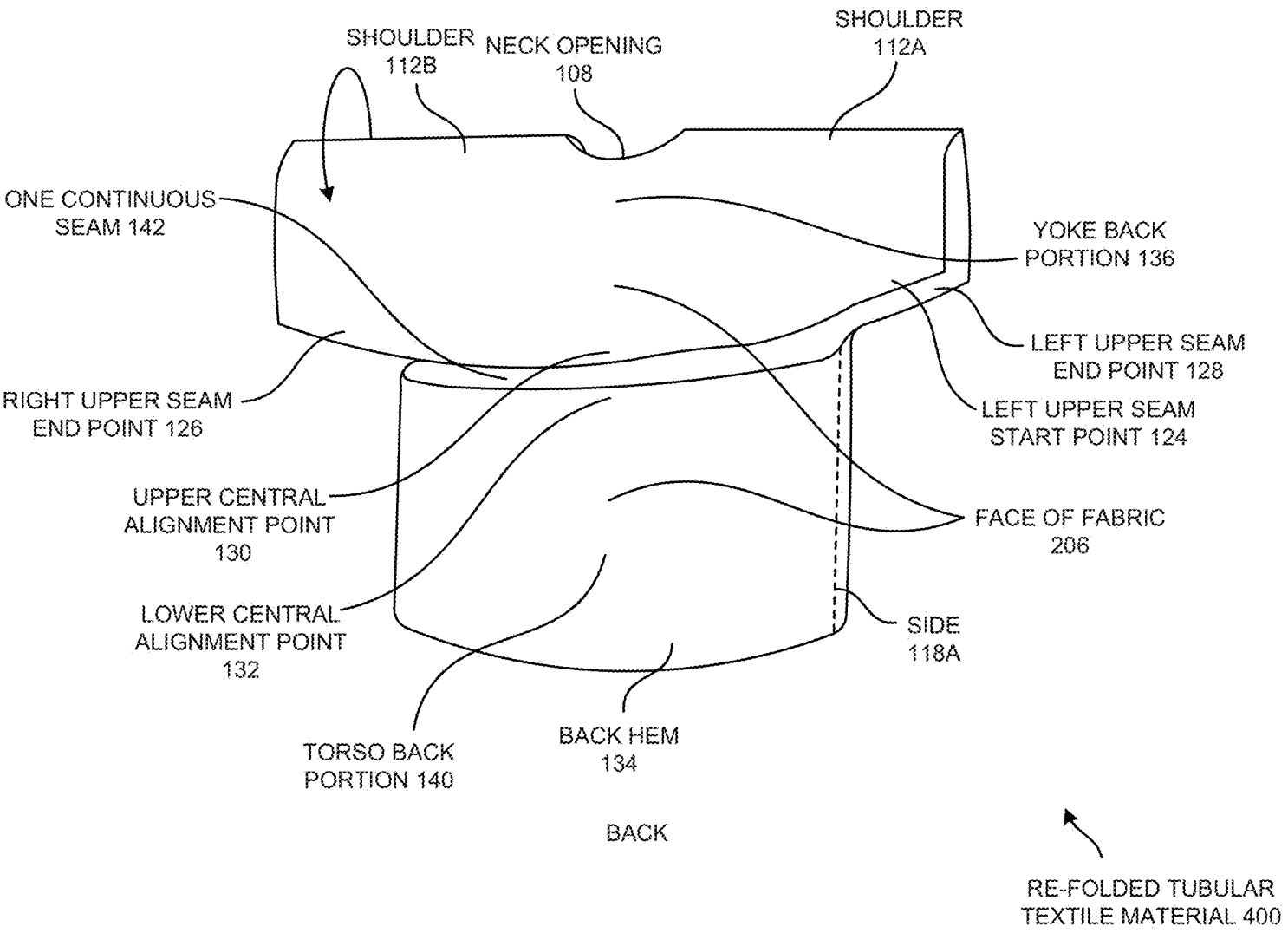
FIG. 4B is a back view of a re-folded tubular textile material, according to one or more embodiments.

FIG. 4B is a back view of the re-folded tubular textile material 400, according to one or more embodiments. FIG. 4B shows the re-folded tubular textile material 400, comprising the yoke back portion 136, the torso back portion 140, the back hem 134, the face of fabric 206, the neck opening 108, the shoulder 112A, the shoulder 112B, the right upper seam start point 122, the left upper seam start point 124, the right upper seam end point 126, the left upper seam end point 128, the upper central alignment point 130, the lower central alignment point 132, and the one continuous seam 142, according to one or more embodiments.

According to one embodiment, FIG. 4B discloses the re-folded tubular textile material 400, illustrating the back view of the shirt 100. The re-folded tubular textile material 400 may include the yoke back portion 136, which may form the upper back section of the shirt 100, and/or may connect to the torso back portion 140, which may form the lower back section. The back hem 134 may be positioned at the lower edge of the torso back portion 140, which may provide a finished boundary for the back side of the shirt 100. The neck opening 108 may be centrally located within the yoke back portion 136 to provide a passage for the wearer's head. The face of fabric 206 may represent the visible side of the shirt 100 during assembly. Key alignment points, including the right upper seam end point 126, the left upper seam end point 128, the upper central alignment point 130, and/or the lower central alignment point 132, may ensure precise positioning and/or connection of the back sections during the formation of the one continuous seam 142. The one continuous seam 142 may extend continuously to join the yoke back portion 136, the torso back portion 140, and/or the sleeves, ensuring a seamless construction, according to one embodiment.

Figure 5:
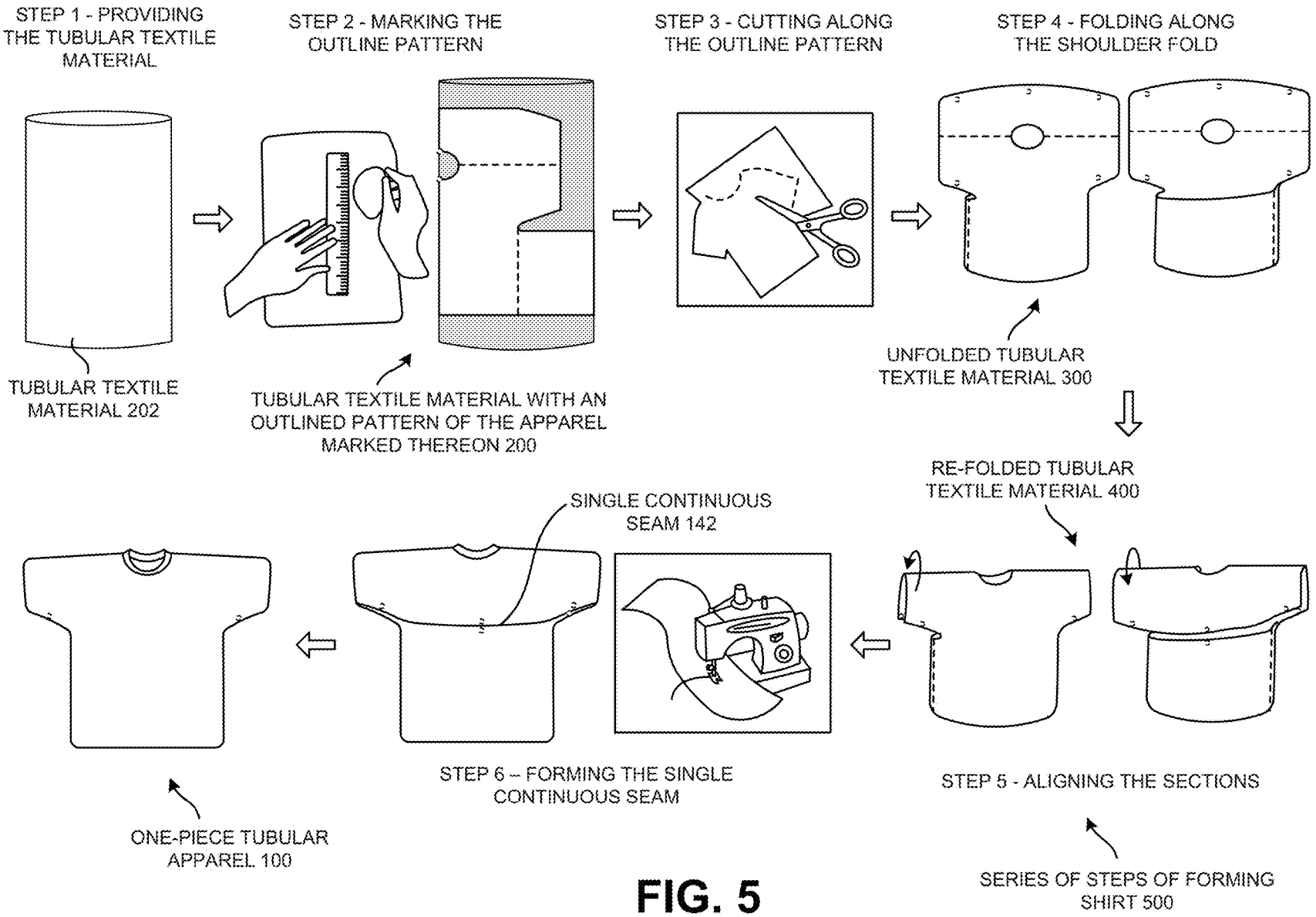
FIG. 5 illustrates a series of steps for forming the shirt of FIGS. 1A & 1B, according to one or more embodiments.

FIG. 5 illustrates the steps for forming the shirt 500 of FIG. 1, according to one or more embodiments.

According to one or more embodiments of FIG. 5, the steps for forming the shirt 500 comprise:

Step 1: Providing the Tubular Textile Material. In step 1, the tubular textile material 202, including the face of fabric 206 and/or the back of fabric 302, is provided as the foundation for the shirt 100, according to one embodiment.

Step 2: Marking the Outlined Pattern. In step 2, the tubular textile material 202 is marked with an outlined pattern 208, according to one embodiment. The pattern defines the yoke front portion 102, the yoke back portion 136, the center front portion 104, the center back portion 138, the torso front portion 106, the torso back portion 140, the front hem 120, the back hem 134, and/or alignment points including but not limited to the right upper seam start point 122, the end point 126, the left upper seam start point 124, then the end point 128, the upper central alignment point 130, and/or the lower central alignment point 132, according to one embodiment.

Step 3: Cutting Along the Outlined Pattern. In step 3, the tubular textile material 202 is cut along the outlined pattern 208 to separate the defined sections into a single-piece fabric, according to one embodiment.

Step 4: Folding Along the Shoulder Fold. In step 4, the material is folded along the shoulder fold 204 to align the center back portion 138 with the torso back portion 140, according to one embodiment.

Step 5: Aligning the Sections, In step 5, the yoke back portion 136 is aligned with the torso back portion 140, according to one embodiment. The right upper seam end point 126 is positioned with the right upper seam start point 122, according to one embodiment. The upper central alignment point 130 is positioned with the lower central alignment point 132, according to one embodiment. Furthermore, the left upper seam start point 124 is positioned with the left upper seam end point 128, according to one embodiment.

Step 6: Forming the one continuous seam. In step 6, the one continuous seam 142 is formed starting at the right upper seam start point 122, according to one embodiment. The one continuous seam extends to the right upper seam end point 126, connecting the sleeve 114A to the yoke back portion 136, proceeding through the center back portion 138 and torso back portion 140, and terminating at the left upper seam end point 128, according to one embodiment. Once the one continuous seam 142 is installed, the shirt 100 is substantially completed, according to one embodiment.

Step 7: Applying Overlapping seames. In step 7, overlapping seames may be applied at the right upper seam points (122 and 126) and/or the left upper seam points (124 and 128) to reinforce the one continuous seam 142, according to one embodiment.

Step 8: Finishing the Hems. In step 8, the front hem 120 and/or back hem 134 are finished, completing the shirt 100 with a polished appearance, according to one embodiment.

Figure 6:
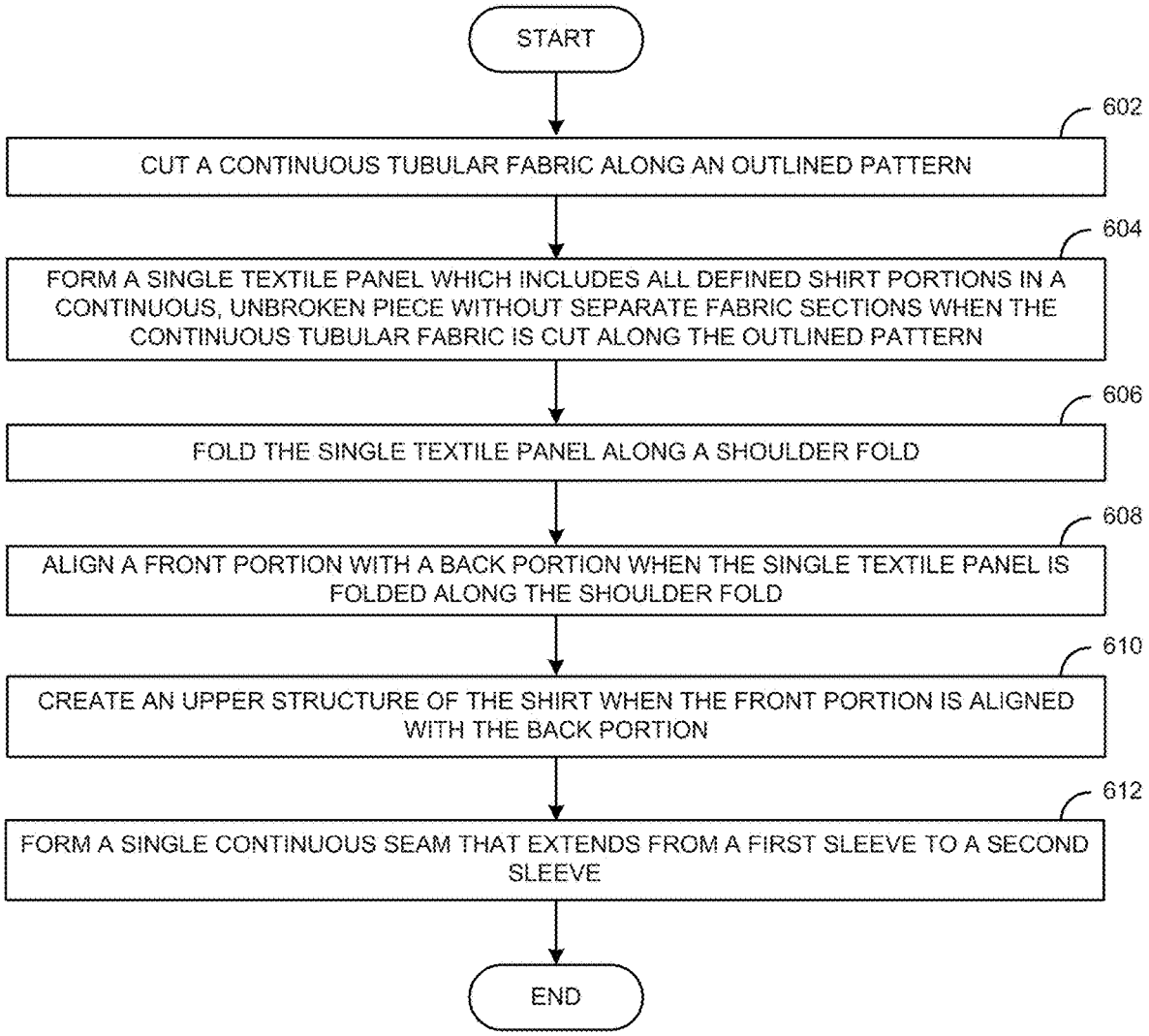
FIG. 6 is a process flow illustrating the steps for forming the shirt of FIG. 1, according to one or more embodiments Other features of the present embodiments will be apparent from the accompanying drawings and from the detailed description that follows.

FIG. 6 is a process flow illustrating a method of forming the shirt 100 of FIG. 1, according to one or more embodiments. The method begins with operation 602, which involves cutting a continuous tubular fabric (e.g., 202) along an outlined pattern. In operation 604, a single textile panel is formed, which includes all defined shirt portions in a continuous, unbroken piece without separate fabric sections when the continuous tubular fabric (e.g., 202) is cut along the outlined pattern. In operation 606, the single textile panel is folded along a shoulder fold. In operation 608, a front portion is aligned with a back portion when the single textile panel is folded along the shoulder fold. In operation 610, an upper structure of the shirt is created when the front portion is aligned with the back portion. In operation 612, a single continuous seam is formed that extends from a first sleeve to a second sleeve.

An example embodiment will now be described. Jane Doe is an active individual who enjoys versatile and comfortable clothing that suits her dynamic lifestyle, according to one embodiment. Jane prefers apparel that provides ease of movement and durability without sacrificing style, according to one embodiment. In the past, Jane struggled with traditional t-shirts that were constructed from multiple fabric pieces, requiring numerous seams and joints, which often caused discomfort during extended wear, according to one embodiment. Jane frequently found that these seams created friction points, especially during physical activities, leading to irritation and reduced overall comfort, according to one embodiment. Additionally, Jane noticed that traditional t-shirt manufacturing often resulted in wasted fabric and higher costs, making sustainable options difficult to find, according to one embodiment.

One day, Jane discovered the innovative shirt described in FIGS. 1-6, according to one embodiment. This apparel is constructed using a single piece of tubular textile material, eliminating the need for multiple fabric sections and excessive seams, according to one embodiment. Jane immediately appreciated the seamless design of the shirt, which includes a yoke front portion 102, a yoke back portion 136, a center front portion 104, and a center back portion 138, all integrated into a single cut of fabric, according to one embodiment.

Jane particularly valued the garment's one continuous seam 142, which extends continuously across the sleeves 114A and 114B, the torso back portion 140, and the yoke portions 102 and 136, according to one embodiment. This one continuous seam eliminates the discomfort caused by traditional multiple-seam designs, ensuring a smooth fit and freedom of movement, according to one embodiment. Jane found that the strategic placement of alignment markers, such as the right upper seam start point 122 and the upper central alignment point 130, ensured that the garment maintained its intended shape and structure, even during rigorous activities, according to one embodiment.

Additionally, Jane appreciated the unique manufacturing process of the shirt 100, as shown in FIG. 2, which uses an outlined pattern 208 to cut the fabric into a specific shape, according to one embodiment. The single cut of fabric is folded along the shoulder fold 204 and aligned using central alignment points, minimizing waste and creating a streamlined assembly process, according to one embodiment. Jane found that this method not only resulted in a more sustainable product but also provided a stylish and functional design suitable for both activewear and casual settings, according to one embodiment.

By using the shirt of FIGS. 1-6, Jane no longer experiences issues like discomfort from multiple seams or concerns about the environmental impact of her clothing choices, according to one embodiment. Jane can now enjoy a t-shirt that is lightweight, durable, and tailored to her active lifestyle, without sacrificing style or sustainability, according to one embodiment. The innovative design and construction method of the shirt allow Jane to move comfortably and confidently, knowing her clothing is both efficient and eco-friendly, according to one embodiment.

Although the present embodiments have been described with reference to specific example embodiments, it will be evident that various modifications and changes may be made to these embodiments without departing from the broader spirit and scope of the various embodiments. For example, the various devices and modules described herein may be enabled and operated using hardware circuitry (e.g., CMOS-based logic circuitry), firmware, software, or any combination of hardware, firmware, and software (e.g., embodied in a non-transitory machine-readable medium). For example, the various electrical structures and methods may be embodied using transistors, logic gates, and electrical circuits (e.g., application-specific integrated (ASIC) circuitry and/or Digital Signal Processor (DSP) circuitry).

In addition, it will be appreciated that the various operations, processes, and methods disclosed herein may be embodied in a non-transitory machine-readable medium and/or a machine-accessible medium compatible with a data processing system (e.g., data processing device 100). Accordingly, the specification and drawings are to be regarded in an illustrative rather than a restrictive sense.

A number of embodiments have been described. Nevertheless, it will be understood that various modifications may be made without departing from the spirit and scope of the claimed invention. In addition, the logic flows depicted in the figures do not require the particular order shown or a sequential order to achieve desirable results. In addition, other steps may be provided, or steps may be eliminated, from the described flows, and other components may be added to, or removed from, the described systems. Accordingly, other embodiments are within the scope of the following claims.

It may be appreciated that the various systems, methods, and apparatus disclosed herein may be embodied in a machine-readable medium and/or a machine-accessible medium compatible with a data processing system (e.g., a computer system), and/or may be performed in any order.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

The invention claimed is:

1. A method of manufacturing a shirt, comprising, cutting a continuous tubular fabric along an outlined pattern;

forming a single textile panel which includes all defined shirt portions in a continuous, unbroken piece without separate fabric sections when the continuous tubular fabric is cut along the outlined pattern;

folding the single textile panel along a shoulder fold;

aligning a front portion with a back portion when the single textile panel is folded along the shoulder fold;

creating an upper structure of the shirt when the front portion is aligned with the back portion; and forming a single continuous seam that extends from a first sleeve to a second sleeve, wherein the single continuous seam begins at a sleeve edge, passes across the back portion, and terminates at an opposite sleeve edge, and wherein the single continuous seam joins the front portion and the back portion of the single textile panel to form the shirt in a final assembled form.

2. The method of manufacturing the shirt of claim 1, wherein there are no seam lines at the top of each shoulder area of the shirt, when the shirt is in the final assembled form.

3. The method of manufacturing the shirt of claim 1, wherein the shirt is formed entirely from a single continuous tubular fabric without the incorporation of any additional fabric components.

4. The method of manufacturing the shirt of claim 1, wherein the final assembled form includes no back opening and the back portion remains a continuous, unbroken portion of the continuous tubular fabric.

5. The method of manufacturing the shirt of claim 1, wherein the final assembled form includes no tie closure and the back portion remains a continuous, unbroken portion of the continuous tubular fabric.

6. The method of claim 1, wherein the outlined pattern defines an upper horizontal segment that forms an upper back portion of the shirt when assembled.

7. The method of claim 1, wherein the outlined pattern descends from the upper horizontal segment along a shallow slope at an angle of approximately 25 to 35 degrees to form a sleeve-cap seam line.

8. The method of claim 7, wherein the shallow slope transitions into a substantially vertical segment that defines an outer sleeve hem, the outer sleeve hem measuring approximately 6 to 8 inches in a standard adult medium configuration.

9. The method of claim 1, wherein the outlined pattern further includes a curved segment extending inward from the outer sleeve hem to form a front underarm seam and a horizontal segment connecting the lower portion of a back panel to the front underarm seam.

10. The method of claim 1, wherein the outlined pattern continues along a horizontal baseline across a lower edge of the continuous tubular fabric to define both a front hem and a back hem, a baseline corresponding to a garment width of approximately 18 to 22 inches when laid flat.

11. The method of claim 1, wherein an opposing side of the outlined pattern comprises a continuous uncut vertical edge maintaining the seamless nature of the continuous tubular fabric.

12. The method of claim 11, wherein the outlined pattern includes a concave semicircular neckline cutout positioned approximately 40 percent of the distance from a lower edge of the continuous tubular fabric, a neckline having a radius between 3.5 and 5 inches.

13. The method of claim 12, wherein a short vertical section extending upward from the neckline defines a center-back portion that remains uncut, preserving a tubular continuity of the fabric.

14. The method of claim 1, wherein the continuous outline forms an elongated asymmetrical contour characterized by smooth, flowing curves and connecting horizontal and vertical segments that collectively define all garment portions in a single integrated piece.

15. The method of claim 1, wherein cutting of the outlined pattern is performed at least one of manually by a garment worker using fabric shears and automatically by at least one of die-cutting and laser-cutting machine.

16. The method of claim 1, wherein the continuous tubular fabric defines the entire body and sleeve structure of the shirt, such that the final assembled form is formed without addition of supplemental fabric panels.

17. A wearable apparel article comprising:

a single continuous textile panel formed from a continuous tubular fabric, the single continuous textile panel including, in an uncut condition, uninterrupted side regions that maintain tubular continuity;

the single continuous textile panel being cut along an outline pattern defining all functional portions of the wearable apparel article, including a front portion, a back portion, a pair of sleeves, and a neckline, in a single integrated piece;

and a single continuous seam extending from a first sleeve to a second sleeve, the single continuous seam joining the front portion and the back portion of the single continuous textile panel to form the wearable apparel article in a final assembled form, wherein the wearable apparel article is free of a back opening, a tie closure, and separate fabric sections.

* * * * *